US008998655B2

(12) United States Patent
Glick et al.

(10) Patent No.: US 8,998,655 B2
(45) Date of Patent: Apr. 7, 2015

(54) ELECTRICAL TERMINAL

(71) Applicant: Lear Corporation, Southfield, MI (US)

(72) Inventors: Michael Glick, Farmington Hills, MI (US); Slobodan Pavlovic, Novi, MI (US); Tulasi Sadras-Ravindra, Canton, MI (US)

(73) Assignee: Lear Corporation, Southfield, MI (US)

( * ) Notice: Subject to any disclaimer, the term of this patent is extended or adjusted under 35 U.S.C. 154(b) by 97 days.

(21) Appl. No.: 13/904,154

(22) Filed: May 29, 2013

(65) Prior Publication Data

US 2014/0087601 A1 Mar. 27, 2014

Related U.S. Application Data

(60) Provisional application No. 61/704,754, filed on Sep. 24, 2012.

(51) Int. Cl.

| | |
|---|---|
| ***H01R 4/48*** | (2006.01) |
| ***H01R 13/18*** | (2006.01) |
| ***H01R 13/187*** | (2006.01) |

(52) U.S. Cl.

CPC ..... *H01R 13/18* (2013.01); *H01R 13/187* (2013.01)

(58) Field of Classification Search

CPC ..... H01R 13/15; H01R 13/18
USPC ..... 439/839, 691
See application file for complete search history.

(56) References Cited

U.S. PATENT DOCUMENTS

| | | | | |
|---|---|---|---|---|
| 4,040,713 | A | 8/1977 | Konnemann | |
| 5,064,379 | A | 11/1991 | Ryll et al. | |
| 5,147,230 | A | 9/1992 | Plyler et al. | |
| 5,334,058 | A | 8/1994 | Hotea | |
| 5,664,972 | A * | 9/1997 | Zinn et al. | 439/839 |
| 5,755,599 | A | 5/1998 | Hotea | |
| 5,868,590 | A * | 2/1999 | Dobbelaere | 439/839 |
| 6,475,040 | B1 | 11/2002 | Myer et al. | |
| 7,595,715 | B2 | 9/2009 | Pavlovic et al. | |
| 7,876,193 | B2 | 1/2011 | Pavlovic et al. | |
| 7,892,050 | B2 * | 2/2011 | Pavlovic et al. | 439/839 |
| 7,927,127 | B1 | 4/2011 | Glick et al. | |
| 8,366,497 | B2 * | 2/2013 | Glick et al. | 439/839 |

FOREIGN PATENT DOCUMENTS

| | | | |
|---|---|---|---|
| DE | 10019241 | A1 | 10/2001 |
| WO | 8905531 | A1 | 6/1989 |

OTHER PUBLICATIONS

Machine translation of Grote & Hartmann GmbH & Co. KG, DE 10019241 published Oct. 25, 2001.

* cited by examiner

*Primary Examiner* — Phuong Dinh
(74) *Attorney, Agent, or Firm* — Brooks Kushman P.C.

(57) ABSTRACT

An electrical terminal includes a contact portion having a contact portion base with at least three sides forming a generally polyhedron structure. The contact portion has a plurality of contact arms, with at least one of the contact arms extending from at least some of the sides. The contact arms are arranged to receive a mating electrical component such that the mating electrical component contacts at least one of the contact arms associated with each side. A spring arrangement includes a plurality of spring arms, each having a spring head in contact with at least one respective contact arm near a distal end of the contact portion for applying a force thereto in a direction toward a central axis of the terminal, thereby increasing the retention force applied to the mating electrical component.

17 Claims, 3 Drawing Sheets

ELECTRICAL TERMINAL

CROSS-REFERENCE TO RELATED APPLICATIONS

This application claims the benefit of U.S. provisional application No. 61/704,754 filed 24 Sep. 2012, which is hereby incorporated herein by reference.

TECHNICAL FIELD

The present invention relates to an electrical terminal.

BACKGROUND

Electrical terminals are known to have various configurations. Examples of electrical terminals are described in the following patents and patent applications: U.S. Pat. No. 5,334,058, U.S. Pat. No. 6,475,040, DE10019241, U.S. Pat. No. 5,755,599, U.S. Pat. No. 5,664,972, U.S. Pat. No. 4,040,713, U.S. Pat. No. 5,064,379, U.S. Pat. No. 5,147,230, WO8905531, and U.S. Pat. No. 7,595,715. With the increased use of round or square pins to make electrical connections—as opposed to flat blades—a need exists for an electrical terminal that can receive such pins, and which can handle the higher current loads found in many modern applications, as well as maintain required retention force over many insertions and removals of the mating pins.

SUMMARY

Embodiments of the invention may include an electrical terminal having a contact portion with a contact portion base with a plurality of sides forming a polyhedron structure. The contact portion further has a plurality of contact arms, at least one of the contact arms extending from a respective one of at least three of the sides. The contact arms are arranged to receive a mating electrical component to contact each of the contact arms. A spring arrangement includes a plurality of spring arms, each having a spring body and a spring head. Each of the spring bodies is disposed adjacent to and along a length of at least one of the contact arms such that relative lateral movement between the spring bodies and an adjacent contact arm is inhibited. Each of the spring heads is in contact with at least one of the contact arms toward a distal end of the contact portion for applying a force thereto in a direction toward a central axis of the contact portion, thereby increasing a retention force applied to the mating electrical component.

In at least some embodiments of the present invention the spring arrangement further includes a spring base from which each of the spring arms extends. In addition or alternatively, the spring base is disposed within the contact portion, and each of the spring arms extends through the contact portion and along an outside of a respective pair of contact arms. In at least some embodiments, at least a portion of each of the spring bodies is disposed between a respective pair of the contact arms.

Embodiments of the invention may include an electrical terminal having a contact portion including a contact portion base having a plurality of sides and forming a polyhedron structure. The contact portion further includes a respective contact arm extending from a respective one of at least three of the sides, and the contact arms are arranged to receive a mating electrical component to contact each of the contact arms. A spring arrangement includes a plurality of spring arms, each having a spring body and a spring head. Each of the spring bodies is disposed adjacent to and along a length of at least one respective contact arm such that relative lateral movement between the spring bodies and an adjacent contact arm is inhibited. Each of the spring heads is in contact with at least one respective contact arm toward a distal end of the contact portion for applying a force thereto in a direction toward a central axis of the contact portion, thereby increasing a retention force applied to the mating electrical component.

Embodiments of the invention may include an electrical terminal including a contact portion with a plurality of sides forming a polyhedron structure, and at least one contact arm extending from a respective one of at least three of the sides and arranged to receive a mating electrical component to contact each of the contact arms. A spring arrangement includes a plurality of spring arms, each having a spring body and a spring head. Each of the spring bodies being disposed adjacent to and along a length of at least one of the contact arms such that relative lateral movement between the spring bodies and an adjacent contact arm is inhibited. Each of the spring heads is in contact with at least one of the contact arms toward a distal end of the contact portion for applying a force thereto in a direction toward a central axis of the contact portion, thereby increasing a retention force applied to the mating electrical component.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
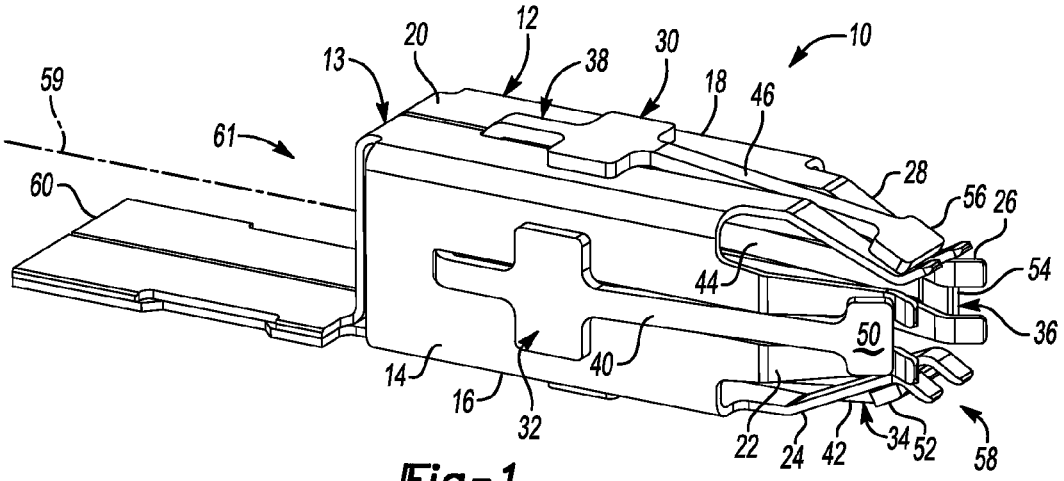
FIG. 1 shows a perspective view of an electrical terminal in accordance with an embodiment of the present invention.

FIG. 1 shows a perspective view of an electrical terminal 10 in accordance with an embodiment of the present invention. The terminal 10 includes a contact portion 12 having a contact portion base 13 having sides 14, 16, 18, 20 forming a generally rectangular structure. The contact portion 12 further includes four pairs of contact arms 22, 24, 26, 28, each extending from a respective one of the sides 14, 16, 18, 20. As described in more detail below, the contact arms 22, 24, 26, 28 are arranged to receive a mating electrical component, such as a round or square pin, such that each pair of contact arms 22, 24, 26, 28 contacts the mating electrical component.

The terminal 10 also includes a spring arrangement 30 that includes four spring arms 32, 34, 36, 38. Each of the spring arms 32, 34, 36, 38 has a respective spring body 40, 42, 44, 46 disposed along a central portion of a respective pair of the contact arms 22, 24, 26, 28. Each of the spring arms 32, 34, 36, 38 also includes a respective spring head 50, 52, 54, 56 in contact with a respective pair of the contact arms 22, 24, 26, 28 toward a distal end 58 of the contact portion 12. Although the spring heads 50, 52, 54, 56 do not contact the very ends of the respective pairs of contact arms 22, 24, 26, 28 in this embodiment—i.e., the contact is made near the distal end 58—in other embodiments, the contact may occur directly at or closer to the distal end, or even farther back from the distal end than is shown in the embodiment in FIG. 1. The spring heads 50, 52, 54, 56 apply a force to the respective pair of contact arms 22, 24, 26, 28 in a direction that is toward an opposite pair of the contact arms—e.g., the spring head 56 applies a force to the contact arms 28 in a direction toward the opposite pair of contact arms 24; similarly, the contact head 34 applies a force to the contact arms 24 in a direction toward the opposite pair of contact arms 28. As explained in more detail below, the configuration of the spring arrangement, and in particular the contact of the spring heads to the respective pairs of contact arms, increases the retention force that will be applied to a mating electrical component, such as a pin.

Although the embodiment shown in FIG. 1 is a four-sided generally rectangular structure, embodiments of the present invention may include less than or more than four sides to create a different type of generally polyhedron structure. For example, a three-sided structure may have a generally triangular cross section, and a five-sided structure may have a generally pentagonal cross section. In such a case, a spring would not apply a force to a set of contact arms in a direction toward an opposite pair of contact arms since the above examples have an odd number of sides. Rather, the springs in these embodiments will apply a force on the respective contact arms in a direction toward a central axis of the contact portion 12, such as the axis 59 shown in FIG. 1. In addition to the embodiments described above, a contact portion, such as the contact portion 12, may have an odd or even number of sides, but have contact arms extending out from only some of the sides. For example, the contact portion 12 could be configured as an octagonal structure, but have contact arms extending out from only four sides.

A terminal, such as the terminal 10 may be effective for use in high current applications, where a soft copper conductor may lose its retention force in the presence of the potentially high heat associated with some high current applications. To help avoid this problem, some prior art electrical terminals use a copper alloy that may have better high-temperature properties; however, this is often to the detriment of the conductivity which may be better with a more pure copper or with a softer copper alloy. In the electrical terminal shown in FIG. 1, the contact portion 12 can be made from a relatively soft copper material, such as C151, or other material having good conductivity such as an aluminum alloy, while the spring arrangement 30 can be made from a relatively stiff and strong steel, such as 301 stainless steel.

Although the tension applied to the contact arms 22, 24, 26, 28 by the spring heads 50, 52, 54, 56 would usually be adequate to keep the components in their relative orientations, the embodiment shown in FIG. 1 provides an additional feature to further ensure that the relative orientation is maintained. As shown in FIG. 1, each of the spring bodies 40, 42, 44, 46 has at least a portion disposed between a respective pair of the contact arms 22, 24, 26, 28, which helps to ensure that the spring heads 50, 52, 54, 56 are in the proper position and apply the force generally equally between each of the respective contact arms in the pairs of contact arms 22, 24, 26, 28. In particular, the arrangement of the contact arms 22, 24, 26, 28 and the associated spring bodies 40, 42, 44, 46 helps to ensure that relative lateral movement between them is prohibited, or at least inhibited or otherwise limited. Also shown in FIG. 1, the contact portion 12 includes a platform 60 configured to connect with a wire or other electrical component, for example, by sonic welding. The platform 60 extends from a proximal end 61 of the contact portion 12.

Figure 2:
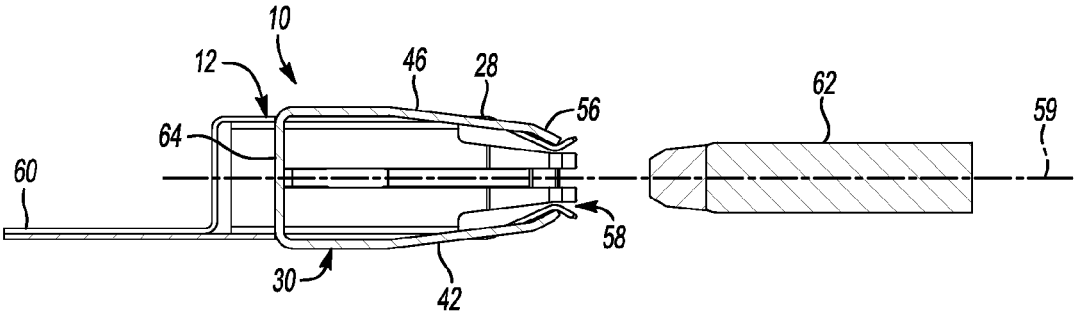
FIG. 2 shows the electrical terminal from FIG. 1 in a cross-sectional view with a mating electrical component in the form of a round pin.

FIG. 2 shows the terminal 10 in a cross-sectional view adjacent a mating electrical component in the form of a round pin 62. As shown in FIG. 2, the spring arrangement 30 includes a spring base 64 disposed within the contact portion 12, and more particularly, within the contact portion base 13, and from which each of the spring arms 32, 34, 36, 38 extends. In the embodiment shown in FIG. 2, the spring arms 32, 34, 36, 38 and the spring base 64 are formed as a unitary structure from a single piece of material. The spring arms 32, 34, 36, 38 extend from the spring base 64 out through the contact portion 12 and along the length of a respective pair of the contact arms 22, 24, 26, 28.

As discussed above, at least a portion of the spring bodies 40, 42, 44, 46 associated with the spring arms 32, 34, 36, 38 is positioned between the two contact arms of a respective pair of contact arms 22, 24, 26, 28. This is visible in the perspective view shown in FIG. 1, where a portion of the spring body 46 is positioned between the two arms forming the pair of contact arms 28. This is also visible in the cross-sectional view of FIG. 2, where it is shown that near the spring base 64, the spring body 46 is above its respective pair of contact arms 28, but closer to the distal end 58 of the contact portion 12 the spring body 46 is positioned below the contact arms 28. As described above, this provides advantages, including maintaining the respective spring head 58 properly positioned on the contact arms 28. Although the spring body 46 and the pair of contact arms 28 were specifically used as an example, it is understood that the other spring bodies 40, 42, 44 and their respective pairs of contact arms 22, 24, 26 are similarly oriented.

Figure 3:
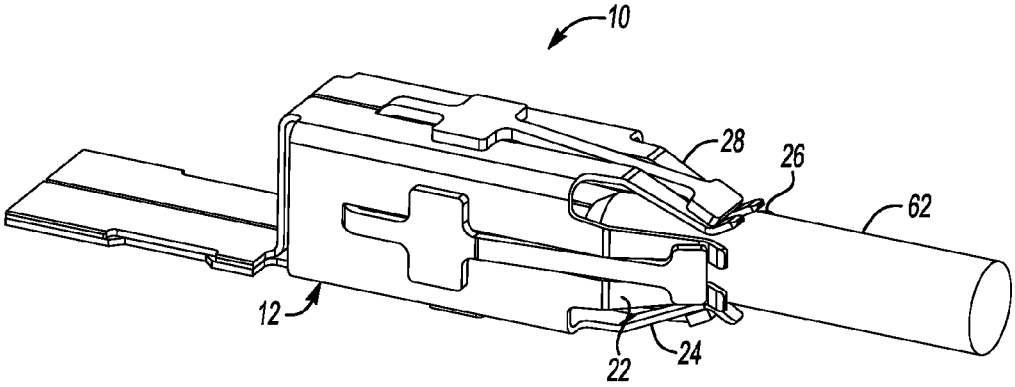
FIG. 3 shows a perspective view of the electrical terminal engaged with the round pin.
Figure 4:
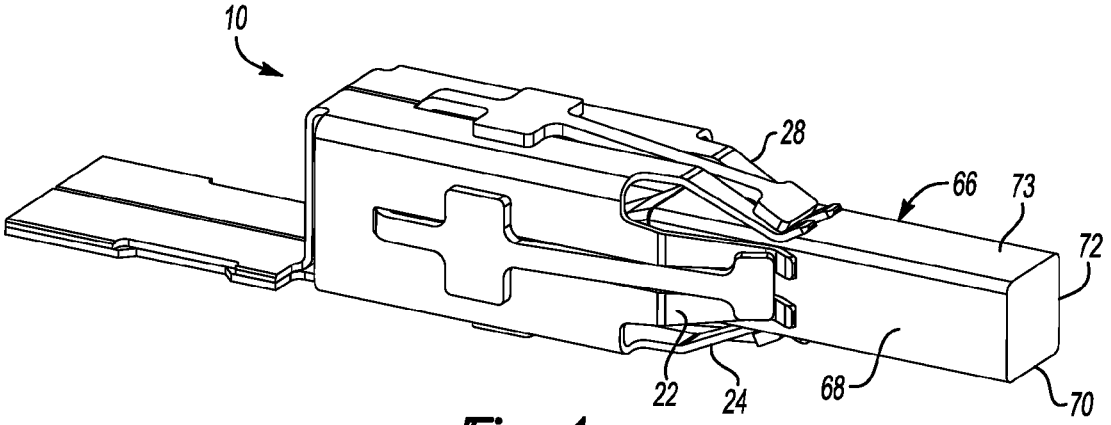
FIG. 4 shows a perspective view of the electrical terminal from FIG. 1 engaged with a mating electrical component in the form of square pin.

FIG. 3 shows the electrical terminal 10 engaged with the pin 62, and as described above, each of the pairs of contact arms 22, 24, 26, 28 are arranged such that they all contact the pin 62 when it is engaged with the terminal 10. Although the electrical terminal 10 may be well-suited for mating with a round component, such as the round pin 62, it may be particularly well-suited for use with a square pin 66—see FIG. 4—where each of the pairs of contact arms 22, 24, 26 (not visible in FIG. 4), 28 mates with a respective flat surface 68, 70, 72, 73 to provide a potentially greater contact area than might be possible with a single contact arm or with pairs of contact arms and a round pin, such as shown in FIG. 3. Because the terminal 10 contacts a mating electrical component, such as a pin, from four sides it may have advantages in both retention strength and durability as compared to a female terminal having only two sets of contact arms configured to receive a flat blade terminal.

Figure 5:
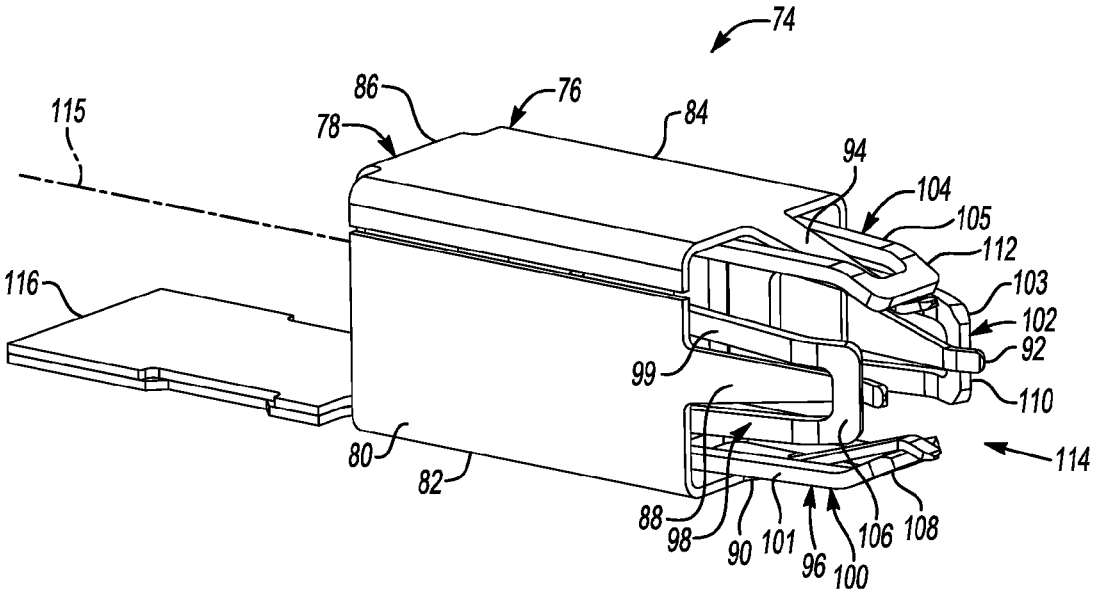
FIG. 5 shows a perspective view of an electrical terminal in accordance with an embodiment of the present invention.

FIG. 5 shows a perspective view of an electrical terminal 74 in accordance with another embodiment of the present invention. The terminal 74 includes a contact portion 76 having a contact portion base 78 and four sides 80, 82, 84, 86 forming a generally rectangular structure. The contact portion 76 further includes four contact arms 88, 90, 92, 94. As described above with regard to the embodiment shown in FIG. 1, the terminal 74 shown in FIG. 5 may also have fewer than or more than four sides, with at least some of them having at least one contact arm extending therefrom. The terminal 74 also includes a spring arrangement 96, which has four spring arms 98, 100, 102, 104. Each of the spring arms 98, 100, 102, 104 includes a pair of elongate members forming respective spring bodies 99, 101, 103, 105 which straddle a respective one of the contact arms 88, 90, 92, 94, and which terminate in a spring head 106, 108, 110, 112.

The spring heads 106, 108, 110, 112 each contact a respective one of the contact arms 88, 90, 92, 94 toward a distal end 114 of the contact portion 76 and apply a force in a direction toward an opposite one of the contact arms 88, 90, 92, 94. More generally, each of the spring heads 106, 108, 110, 112 applies a force to a respective one of the contact arms 88, 90, 92, 94 in a direction toward a central axis 115 of the contact portion 76. Like the terminal 10 shown in FIG. 1, the terminal 74 includes a platform 116 configured to connect with a wire or other electrical component, for example, by sonic welding.

Figure 6:
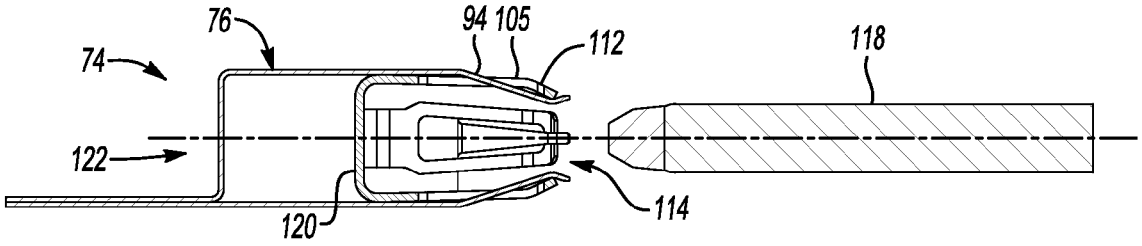
FIG. 6 shows the electrical terminal from FIG. 5 in a cross-sectional view with a mating electrical component in the form of a round pin.

FIG. 6 shows the terminal 74 in a cross-sectional view adjacent a mating electrical component in the form of a round pin 118. As shown in FIG. 6, the spring arrangement 96 includes a spring base 120 disposed within the contact portion 76 and from which each of the spring arms 98, 100, 102, 104 extends. In the embodiment shown in FIG. 6, the spring arms 98, 100, 102, 104 and the spring base 120 are formed as a unitary structure from a single piece of material, which can be, for example, stainless steel or some other material that retains its strength in a relatively high temperature environment. The spring arms 98, 100, 102, 104 extend from the spring base 120 out of the contact portion 74 and along the length of a respective one of the contact arms 88, 90, 92, 94.

As described above in conjunction with FIGS. 1 and 2, a portion of the spring bodies 40, 42, 44, 46 are disposed between the two arms of the respective pairs of contact arms 22, 24, 26, 28. With the terminal 74 shown in FIGS. 5 and 6, a portion of the contact arms 88, 90, 92, 94 are disposed between the two elongate members making up a portion of the spring arms 98, 100, 102, 104—i.e., the spring bodies 99, 101, 103, 105. This is shown in FIG. 5, and further illustrated in FIG. 6, where it is seen that the contact arm 94 is above the spring body 105 near a proximal end 122 of the terminal 74, but then is positioned below it near the distal end 114, such that the spring head 112 is positioned securely on the contact arm 94. Thus, in this embodiment, it is the contact arms 88, 90, 92, 94 which are captured by respective spring arms 98, 100, 102, 104, and are thereby less likely to be subject to undesirable lateral movement when a mating electrical component, such as the pin 118 is repeatedly inserted, and in this way, relative lateral movement between the elements in prohibited or at least inhibited.

Figure 7:
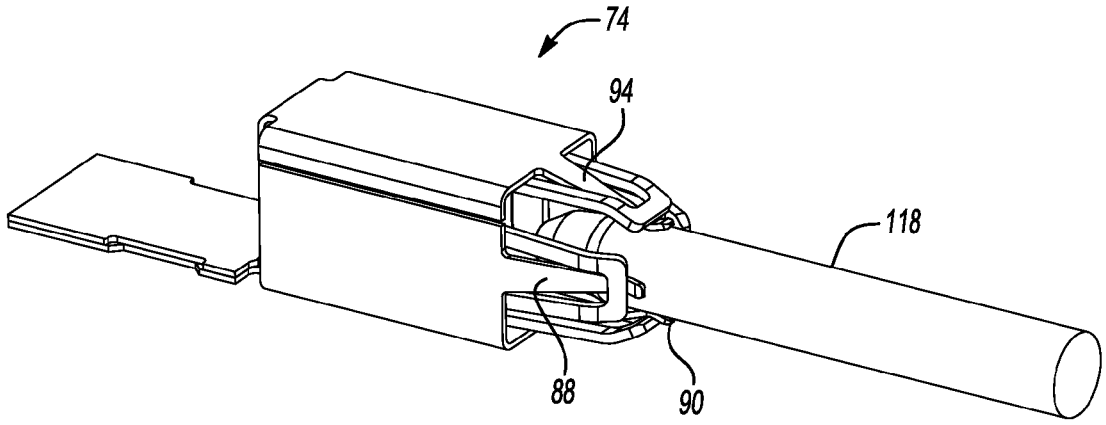
FIG. 7 shows a perspective view of the electrical terminal from FIG. 5 engaged with the round pin.

FIG. 7 shows the electrical terminal 74 engaged with the pin 118, and as described above, the contact arms 88, 90, 92 (see FIG. 5), 94 are arranged such that they all contact the pin 118 when it is engaged with the terminal 74. As described above, the use of a pair of contact arms for each side—see the terminal 10 shown in FIG. 1—may provide the advantage of a greater contact area at the interface of the terminal and the pin (as opposed to a terminal with a single contact arm at each side), particularly when the pin is square. In contrast, the terminal 74, having a single contact arm associated with each of the terminal sides, may provide an advantage when the mating electrical component is a round pin. This is because the round pin may have a tendency to separate contact arms that are arranged as pairs when it is engaged with the terminal. Another issue that could arise is that the pin may interface with the edges of the pairs of contact arms, rather than their respective flat surfaces. With repeated engagement and disengagement of the electrical components, the pins may become scratched or gouged if care is not taken to ensure that the flat surfaces of the contact arms form the interface of the terminal and the pin. With a single contact arm arrangement, such as in the terminal 74, these issues do not arise, or are at least far less likely to occur.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An electrical terminal comprising:

a contact portion including a contact portion base having a plurality of sides and forming a polyhedron structure, the contact portion further including a plurality of contact arms, at least one of the contact arms extending from a respective one of at least three of the sides, the contact arms being arranged to receive a mating electrical component to contact each of the contact arms; and a spring arrangement including a plurality of spring arms, each having a spring body and a spring head, at least a portion of each of the spring bodies being disposed laterally adjacent to and along a length of at least one of the contact arms such that relative lateral movement between the spring bodies and an adjacent contact arm is inhibited, each of the spring heads being in contact with at least one of the contact arms toward a distal end of the contact portion for applying a force thereto in a direction toward a central axis of the contact portion, thereby increasing a retention force applied to the mating electrical component.

2. The electrical terminal of claim 1, wherein the contact portion has four sides and forms a generally rectangular structure.

3. The electrical terminal of claim 1, wherein the contact portion includes a pair of the contact arms extending from a respective one of at least three of the sides and the spring arrangement includes a respective one of the spring arms corresponding to each of the pairs of contact arms.

4. The electrical terminal of claim 3, wherein at least a portion of each of the spring bodies is disposed between a respective pair of the contact arms.

5. The electrical terminal of claim 1, wherein the contact portion includes a single contact arm extending from a respective one of at least three of the sides and the spring arrangement includes a respective one of the spring arms corresponding to each of the contact arms, each of the spring arms including a pair of elongate members forming a respective spring body.

6. The electrical terminal of claim 5, wherein at least a portion of each of the contact arms is disposed between a respective pair of the elongate members.

7. The electrical terminal of claim 1, wherein the spring arrangement further includes a spring base from which each of the spring arms extends, the spring base being disposed within the contact portion.

8. The electrical terminal of claim 7, wherein each of the spring arms extends through the contact portion.

9. An electrical terminal comprising:

a contact portion including a contact portion base having a plurality of sides and forming a polyhedron structure, the contact portion further including a respective contact arm extending from a respective one of at least three of the sides, the contact arms being arranged to receive a mating electrical component to contact each of the contact arms; and a spring arrangement including a plurality of spring arms, each having a spring body and a spring head, at least a portion of each of the spring bodies being laterally disposed adjacent to and along a length of at least one respective contact arm such that relative lateral movement between the spring bodies and an adjacent contact arm is inhibited, each of the spring heads being in contact with at least one respective contact arm toward a distal end of the contact portion for applying a force thereto in a direction toward a central axis of the contact portion, thereby increasing a retention force applied to the mating electrical component.

10. The electrical terminal of claim 9, wherein each of the spring arms includes a pair of elongate members forming a respective spring body, and the contact portion includes a single contact arm extending from a respective one of at least three of the sides and at least partially disposed between a respective pair of the elongate members.

11. The electrical terminal of claim 9, wherein the contact portion includes a pair of the contact arms extending from a respective one of at least three of the sides, and at least a portion of each of the spring bodies is disposed between a respective pair of the contact arms.

12. The electrical terminal of claim 9, wherein the contact portion has four sides and forms a generally rectangular structure.

13. The electrical terminal of claim 9, wherein the spring arrangement further includes a spring base from which each of the spring arms extends, the spring base being disposed within the contact portion.

14. The electrical terminal of claim 13, wherein each of the spring arms extends through the contact portion.

15. An electrical terminal comprising:

a contact portion including:

a plurality of sides forming a polyhedron structure, and at least one contact arm extending from a respective one of at least three of the sides and arranged to receive a mating electrical component to contact each of the contact arms; and a spring arrangement including a plurality of spring arms, each having a spring body and a spring head, each of the spring bodies being disposed adjacent to and along a length of at least one of the contact arms such that relative lateral movement between the spring bodies and an adjacent contact arm is inhibited, each of the spring heads being in contact with at least one of the contact arms toward a distal end of the contact portion for applying a force thereto in a direction toward a central axis of the contact portion, thereby increasing a retention force applied to the mating electrical component, and wherein each of the spring arms includes a pair of elongate members forming a respective spring body, and at least a portion of each of the contact arms is disposed between a respective pair of the elongate members.

16. The electrical terminal of claim 15, wherein the contact portion has four sides and forms a generally rectangular structure.

17. The electrical terminal of claim 15, wherein the spring arrangement further includes a spring base from which each of the spring arms extends, the spring base being disposed within the contact portion.

* * * * *